US008353360B2

(12) United States Patent
Slot et al.

(10) Patent No.: US 8,353,360 B2
(45) Date of Patent: Jan. 15, 2013

(54) PILE DRIVER

(75) Inventors: Hendrik Marcel Slot, Best (NL); Arris Van Duijvenboden, Katwijk (NL)

(73) Assignee: IHC Holland IE B.V., Sliedrecht (NL)

( * ) Notice: Subject to any disclaimer, the term of this patent is extended or adjusted under 35 U.S.C. 154(b) by 142 days.

(21) Appl. No.: 11/996,914

(22) PCT Filed: Jul. 24, 2006

(86) PCT No.: PCT/NL2006/000385

§ 371 (c)(1),
(2), (4) Date: Apr. 8, 2008

(87) PCT Pub. No.: WO2007/013801

PCT Pub. Date: Feb. 1, 2007

(65) Prior Publication Data

US 2008/0223595 A1 Sep. 18, 2008

(30) Foreign Application Priority Data

Jul. 25, 2005 (EP) ..... 05076696

(51) Int. Cl.
*E02D 7/10* (2006.01)

(52) U.S. Cl. ..... 173/90; 173/93.6; 173/126; 173/127; 173/131; 173/DIG. 1; 173/DIG. 3; 384/24; 384/35; 384/42; 384/101; 405/228

(58) Field of Classification Search ..... 173/90, 173/93.6, 126–127, 131, DIG. 1, DIG. 3; 384/24, 35, 42, 101; 405/228
See application file for complete search history.

(56) References Cited

U.S. PATENT DOCUMENTS

| | | | | |
|---|---|---|---|---|
| 4,129,002 | A * | 12/1978 | Schnell | 60/633 |
| 4,187,917 | A * | 2/1980 | Bouyoucos | 173/131 |
| 4,367,800 | A * | 1/1983 | Arentsen | 173/127 |
| 4,575,282 | A * | 3/1986 | Pardue et al. | 405/228 |
| 4,601,349 | A | 7/1986 | Arentsen | |
| 5,447,774 | A * | 9/1995 | Tanaka et al. | 428/141 |
| 5,516,214 | A * | 5/1996 | Kakumoto et al. | 384/492 |
| 5,707,718 | A * | 1/1998 | Matsukawa et al. | 428/218 |
| 5,743,707 | A * | 4/1998 | Battig et al. | 415/113 |
| 6,171,070 | B1 * | 1/2001 | Mitake | 417/273 |

(Continued)

FOREIGN PATENT DOCUMENTS

DE 102 26 264 A1 12/2003

(Continued)

OTHER PUBLICATIONS

International Search Report for PCT/NL2006/000385 dated Jan. 16, 2007.

*Primary Examiner* — Brian D Nash
*Assistant Examiner* — Michelle Lopez

(57) ABSTRACT

A pile driver provided with a housing and at least one body connected with the housing so as to be moved back and forth over a predetermined path, the pile driver being further provided with a drive for moving the body back and forth over the path for the purpose of pile-driving, the pile driver comprising at least two parts movable relative to each other, respectively having at least a first type of sliding surface and at least a second type of sliding surface which during pile-driving slide along each other and between which there is a lubricant, wherein the first type of sliding surface is provided with polyether ether ketone.

12 Claims, 3 Drawing Sheets

Figure 1A:
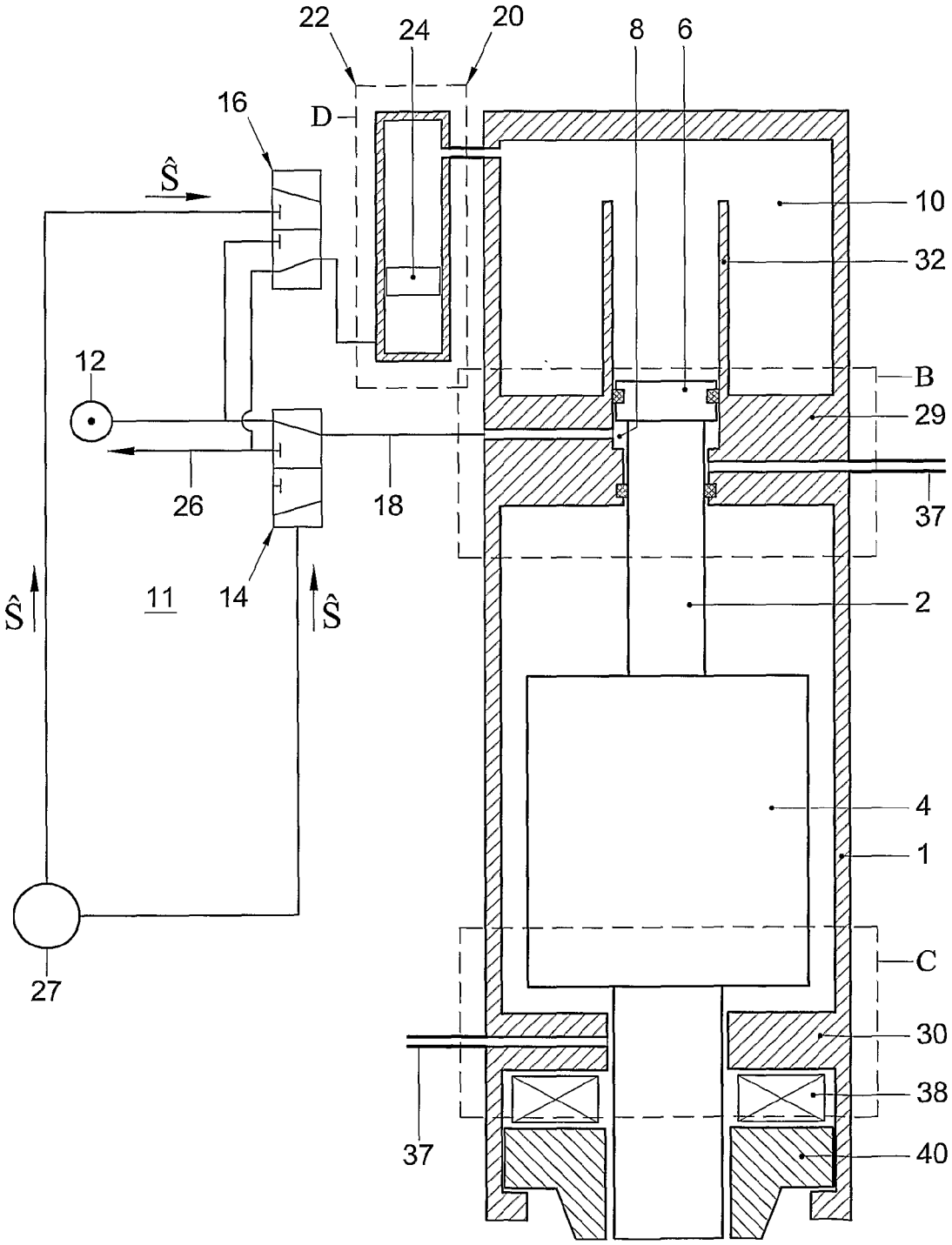

U.S. PATENT DOCUMENTS 6,575,631 B2 * 6/2003 Shoda et al. ..... 384/47
6,994,474 B2 * 2/2006 Kinno et al. ..... 384/492
7,118,808 B2 * 10/2006 Wolki et al. ..... 428/626
7,172,343 B2 * 2/2007 Kinno et al. ..... 384/492
7,289,752 B2 * 10/2007 Yamazaki et al. ..... 399/167
7,314,646 B2 * 1/2008 Sawyer et al. ..... 427/58
7,448,445 B2 * 11/2008 Doane et al. ..... 166/196
7,481,635 B2 * 1/2009 Nishikawa et al. ..... 418/232
2009/0103840 A1 * 4/2009 Hibi et al. ..... 384/100
2009/0242471 A1 * 10/2009 Shinoda et al. ..... 210/170.11

FOREIGN PATENT DOCUMENTS

JP 10 184692 A 7/1998
JP 2003 221943 A 8/2003

* cited by examiner

PILE DRIVER

FIELD OF THE INVENTION

The invention relates to a pile driver provided with a housing and at least one body connected with the housing so as to be movable back and forth over a predetermined path, the pile driver being further provided with a drive for moving the body back and forth over the path for the purpose of pile-driving, the pile driver comprising at least two parts movable relative to each other, respectively having at least a first type of sliding surface and at least a second type of sliding surface which during pile-driving slide along each other and between which there is a lubricant.

BACKGROUND

Such a pile driver is known per se and is suitable for driving a pile into a surface. To this end, the body is placed on the pile. Next, using the drive, the body is lifted relative to the pile along the predetermined path and then lowered onto the pile using the drive and/or gravity. By repeating this method, the pile is driven into the ground. Such piles can for instance form a foundation for constructions on land or at sea.

When pile-driving is done to form a foundation at sea, it may be necessary to perform pile-driving underwater, for instance when building oil rigs. To adapt the pile driver for use under water, the lubricant can comprise water or even seawater, which provides the advantage that lubricant leaking from between the sliding surfaces to surrounding water, or surrounding water penetrating between the sliding surfaces, does not have any significant influence on the movable parts' sliding along each other.

A drawback of the known pile driver is that, for instance if water is used as lubricant, the parts are highly susceptible to corrosion and wear.

SUMMARY OF THE INVENTION

The object of the invention is to make the sliding surfaces of the parts of such design that corrosion and/or wear on the parts is prevented.

This object has been achieved by means of the invention, which is characterized in that the first type of sliding surface is provided with polyether ether ketone.

Polyether ether ketone has a high mechanical strength, which renders it suitable for use in a pile driver. Furthermore, polyether ether ketone has a low coefficient of friction and it has a corrosion-reducing action, which is beneficial to the durability of the movable parts.

A preferred embodiment of the pile driver according to the invention is characterized in that the second sliding surface is provided with stainless steel, specifically stainless steel 2205. Tests have demonstrated that material provided with polyether ether ketone in combination with stainless steel and in particular stainless steel 2205 gives optimum friction-reducing and wear-reducing results, whilst remaining suitable for use in a pile driver.

When the body is located in a part of the housing which comprises stainless steel, it may be preferred that at least a part of the housing forms a sliding surface of the second type and at least a part of the body forms a sliding surface of the first type. An advantage thereof is that the invention can be implemented in an easy way.

If it is preferred that the body is substantially made of stainless steel, it is advantageous that at least a part of the housing forms a sliding surface of the first type and at least a part of the body forms a sliding surface of the second type. An advantage thereof is, again, the simple way in which the invention can be implemented.

Furthermore, a possible embodiment of the pile driver according to the invention is characterized in that the body comprises an impact weight. Such an impact weight facilitates pile-driving, since the large mass of the impact weight results in a high pile-driving force.

Further, a possible embodiment of the pile driver according to the invention is characterized in that the pile driver is provided with at least one fluid pressure connection which extends from an inside of a pressure chamber included in the housing to a position outside the pressure chamber, while in the fluid pressure connection a sealing movable relative to this connection is included. In this way, the pressure from outside the housing can be transferred a fluid present outside the housing. Through this transfer of pressure, the housing can be relieved of any excess pressure or reduced pressure present. As a consequence, the material of the housing is free of tension, which is beneficial to the durability of the housing.

In the latter embodiment, at least a part of the fluid pressure connection can form a sliding surface of the first type and at least a part of the sealing can form a sliding surface of the second type.

It is also possible that at least a part of the fluid pressure connection forms a sliding surface of the second type and at least a part of the sealing forms a sliding surface of the first type. Since such a fluid pressure connection is usually formed by a tube of stainless steel, such as stainless steel 2205, this has the advantage of easy implementation A preferred embodiment of the pile driver according to the invention may be provided with supply means for supplying water from an environment of the housing, between the sliding surface of the first type and the sliding surface of the second type when the housing is underwater. In this way, it is possible to provide for sufficient lubricant between the sliding surfaces.

The pile driver according to the invention will be further elucidated with reference to the drawing, where identical reference signs refer to corresponding parts. In the drawing:

BRIEF DESCRIPTION OF THR DRAWINGS

Figure 1B:
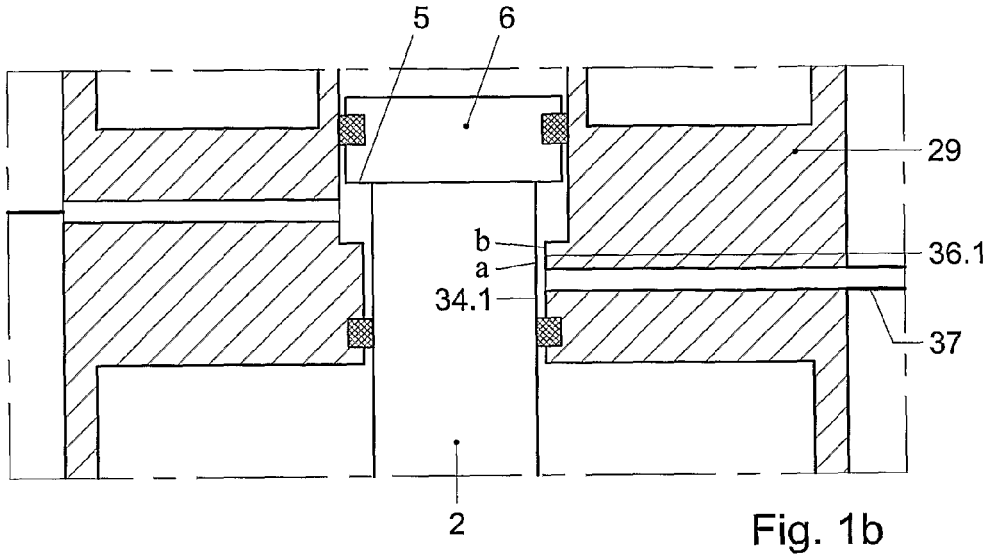
Figure 1C:
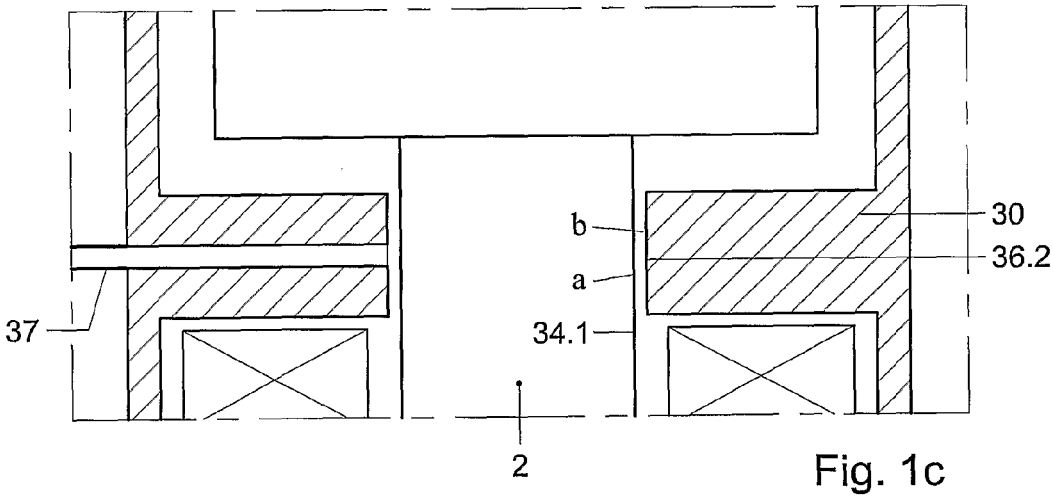
Figure 1D:
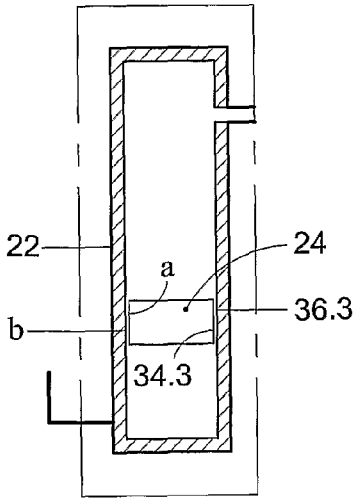
Figure 2:
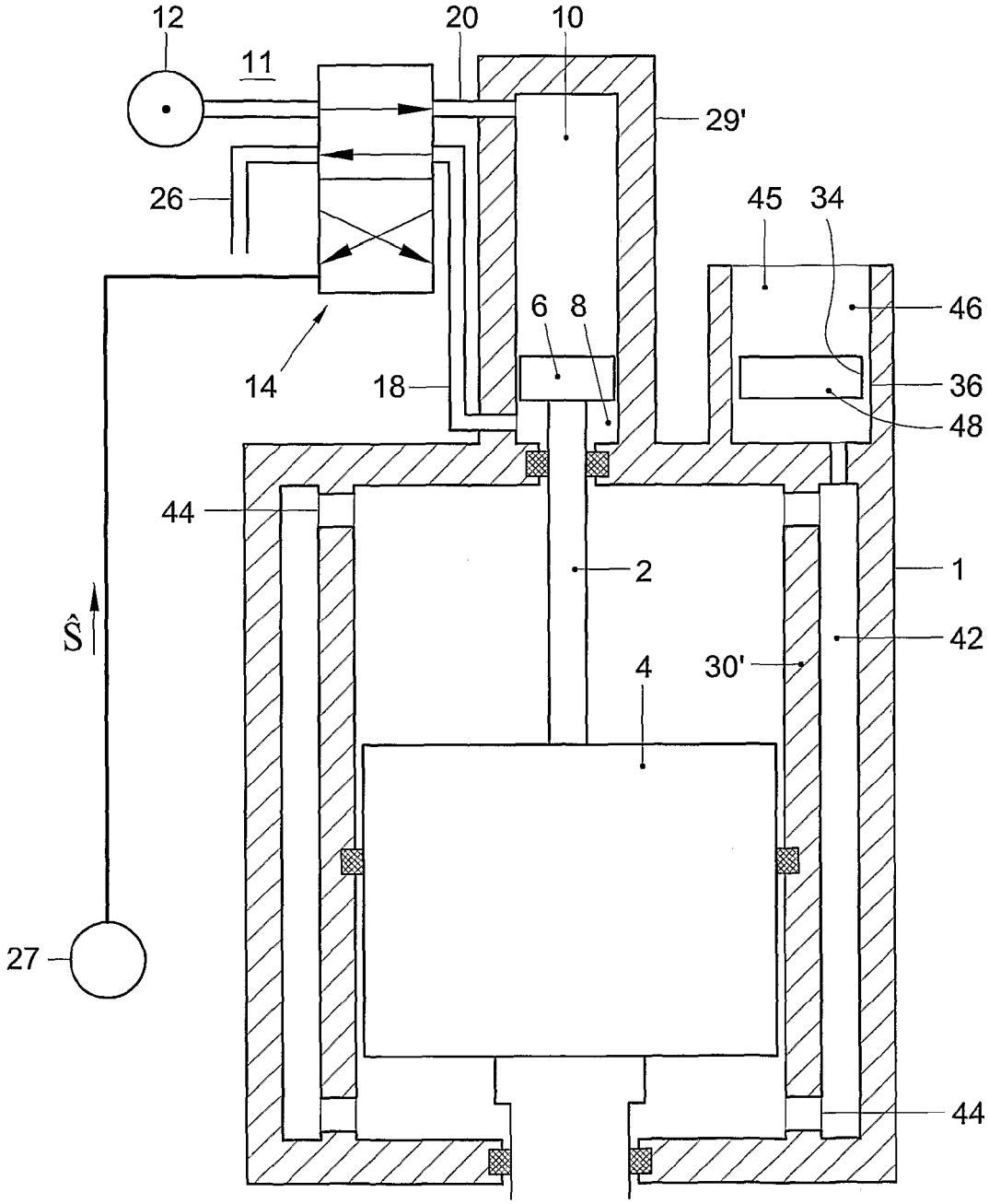

FIG. 1*a* shows a longitudinal cross-section of a first embodiment of the pile driver according to the invention;

FIG. 1*b* shows a detailed view of the dotted box indicated in FIG. 1*a* by B;

FIG. 1*c* shows a detailed view of the dotted box indicated in FIG. 1*a* by C;

FIG. 1*d* shows a detailed view of the dotted box indicated in FIG. 1*a* by D; and FIG. 2 shows a longitudinal cross-section of a second embodiment of the pile driver according to the invention.

DETAILED DESCRIPTION OF THE DRAWINGS

FIG. 1*a* shows a longitudinal section of a first embodiment of the pile driver. The pile driver is provided with a housing 1 and a body 2, connected with the housing 1, which body 2 is provided with an impact weight 4 and furthermore, at an upper side of the body 2, is provided with a piston 6.

The housing 1 is provided with a first pressure chamber 8, from where a pressure can be exerted on at least a portion of an underside 5 of the piston 6, and a second pressure chamber 10, from where a pressure can be exerted on an upper side of the piston 6. In this embodiment, in the first pressure chamber 8, water, for instance seawater, is used as pressure medium, and in the second pressure chamber 10 a gas, for instance air, is used as pressure medium.

The pile driver is further provided with a drive 11 for generating a varying pressure. The drive 11 is provided with a pressure source 12, a first control slide 14 and a second control slide 16, which drive 11 is connected through first and second fluid pressure connections 18, 20 with the first pressure chamber 8 and the second pressure chamber 10, respectively. In this embodiment of the pile driver, the pressure source 12 utilizes water as pressure medium. The second fluid pressure connection 20 is provided with an assembly of a connecting chamber 22 having therein a sealing in the form of a floating piston 24 which is movable relative to the connecting chamber 22. Because the pressure medium of the pressure source 12 is water, and the pressure medium of the second pressure chamber is a gas, in the connecting chamber 22 water and gas are present on opposite sides of the floating piston 24. The assembly of the connecting chamber 22 and the floating piston 24 is arranged for separating the water and the gas, so that no water will leak to the second pressure chamber 10 and no gas will leak to the pressure source 12.

By means of the respective control slides 14, 16, the fluid pressure connections 18, 20 can be connected to and uncoupled from the pressure source 12 or the discharge 26. The first control slide 14 can be brought in two positions. In the first position of the first control slide 14, the first control slide 14 and the first fluid pressure connection 18 transfer pressure of the pressure source 12 to the first pressure chamber 8. In the second position of the first control slide 14, the first control slide 14 and the first fluid pressure connection 18 remove pressure in the first pressure chamber 8 by way of a discharge 26. The second control slide 16 can also be brought in two positions. In the first position of the second control slide 16, the second control slide 16 and the second fluid pressure connection 20 transfer pressure of the pressure source 12 to the second pressure chamber 10. In the second position of the second control slide 16, the second control slide 16 and the second fluid pressure connection 20 remove pressure in the second pressure chamber 10 by way of the discharge 26. Further, in this embodiment of the pile driver, a control device 27 is provided which generates a control signal S for controlling the control slides 14, 16.

The housing 1 is provided with a first and a second guide ring 29, 30 and a cylinder 32. In use, the body 2 is guided by the first and the second guide rings 29, 30 and the cylinder 32, so that the body is connected with the housing so as to be movable back and forth over a predetermined path.

As can be seen in FIGS. 1*b*, 1*c* and 1*d*, in this embodiment of the pile driver, at least a part of the body 2 forms a first sliding surface 34.1 and at least a part of the housing 1, in particular the guide ring 29, forms a second sliding surface 36.1. Furthermore, in this embodiment of the pile driver, at least a part of the body 2 forms a third sliding surface 34.2 and at least a part of the housing 1, in particular the guide ring 30, forms a fourth sliding surface 36.2. Furthermore, at least a part of the floating piston 24 forms a fifth sliding surface 34.3 and at least a part of the connecting chamber 22 forms a sixth sliding surface 36.3.

In FIGS. 1*b*, 1*c* and 1*d*, it can be seen that the first, third and fifth sliding surfaces 34.1, 34.2 and 34.3 can slide along the second, fourth and sixth sliding surfaces 36.1, 36.2 and 36.3, respectively. The first, third and fifth sliding surfaces 34.1, 34.2, 34.3 in this example are sliding surfaces of the first type a and the second, fourth and sixth sliding surfaces 36.1, 36.2 and 36.3 are sliding surfaces of the second type b. It is also possible, however, that for instance the first sliding surface 34.1 is of type b and that the second sliding surface 36.1 is of type a and/or the third sliding surface 34.2 is of type b and the fourth sliding surface 36.2 is of type a, as long as during pile-driving in each case a sliding surface of the first type a slides along a sliding surface of the second type b.

The sliding surfaces of the first type a are provided with materials based on polyether ether ketone (PEEK), such as, for instance, PEEK-BG, optionally with friction-reducing or other additions. Such additions may comprise carbon, PTFE, graphite and/or carbonfibre. The sliding surfaces of the second type b are for instance provided with a form of stainless steel, in this example for instance stainless steel 2205. Between the first type and second type of sliding surfaces there is a lubricant, for instance seawater. It has been found that if one of the sliding surfaces of the first type a, which comprise polyether ether ketone, slides along one of the sliding surfaces of the second type b, which comprise stainless steel, with for instance seawater as lubricant, the sliding surfaces experience very little friction from each other and are subject to very little corrosion.

The guide rings 29, 30 are further provided with supply means 37 for supplying water from an environment of the housing 1, between the first and second sliding surfaces 34.1, 36.1 and the third and fourth sliding surfaces 34.2 and 36.2. Such supply means 37 can for instance comprise a supply regulator (not shown in the drawing) and a conduit.

In this embodiment, the guide ring 30 is supported on a shock absorber 38 and a retaining ring 40 of the housing 1.

The pile driver is normally utilized with the aid of the following method. In the condition shown in FIG. 1, the first control slide 14 is in its first position, so that the pressure of the pressure source 12 is transferred to the first pressure chamber 8. The second control slide 16 is in its second position, so that pressure in the second pressure chamber 10 is discharged via the discharge 26. As a result of the pressure difference between the first and second pressure chambers 8, 10, the piston 6 and hence also the body 2 is moved upwards.

When the body 2 has reached a sufficient height, the control device 27 generates a signal to the control slides 14, 16. At least virtually simultaneously, the first control slide 14 is moved to the second position and the second control slide 16 is moved to the first position. As a result, the first pressure chamber 8 enters into communication with the discharge 26, and the second pressure chamber 10 enters into communication with the pressure source 12. The pressure in the first pressure chamber 8 then increases and the pressure in the second pressure chamber 10 decreases. As a result, and in this example also by virtue of gravity, the body 2 is moved down and a pile (not shown in the drawing) placed under the body 2 is driven into a surface. After this, the first and second control slides 14, 16 are moved back again to the first and the second position, respectively, so that the body 2 is moved up again. As the body 2 is moved back and forth, in this example up and down, the sliding surfaces of the first type a and the second type b, respectively, slide along each other.

By repeating the above method, the pile can be driven into the surface to a desired depth.

FIG. 2 shows a longitudinal section of a second embodiment of the pile driver. This embodiment to some extent corresponds to the first embodiment. In this embodiment, however, the housing 1 comprises a first guide chamber 29' and a second guide chamber 30'. In addition, in this embodiment of the pile driver, only one control slide 22 is provided for connecting fluid connections 18, with the pressure source 12 or the discharge 26. Also, there is no connecting chamber present in the second fluid connection 20, since in this embodiment the pressure chambers 8, 10 and the pressure source 12 utilize the same pressure medium.

The control slide 14 has two positions. In the first position, the pressure source 12 is in contact with a portion of the first guide chamber 29' above the piston 6, so that the pressure of the pressure source 12 is transferred to the portion of the first guide chamber 29' above the piston 6. This portion above the piston 6 forms the second pressure chamber 10. The portion of the first guide chamber 29' under the piston 6 forms the first pressure chamber 8 and in the first position is in contact with the discharge 26, so that the pressure of the portion of the first guide chamber 29' under the piston is discharged via the discharge 26. In the second position, the pressure source 12 is in contact with the first pressure chamber 8, so that the pressure of the pressure source 12 is passed to the portion of the first guide chamber 29' under the piston 6. The second pressure chamber 10 is then in contact with the discharge 26, so that the pressure of the portion of the first guide chamber 29' above the piston 6 is discharged.

The housing 1 is circumferentially provided with an annular chamber 42, which chamber on one side communicates via openings 44 with guide chamber 29' of the housing 1 and on the other side through fluid pressure connection 45 communicates with an environment of the pile driver. Here, the fluid pressure connection 45 comprises a connecting chamber 46, which connecting chamber 46 is provided with a floating piston 48. Via the openings 44, the annular chamber 42 and the fluid pressure connection 45, an ambient pressure is transferred to an inside of the housing. Through this transfer of pressure, the housing can be relieved of any reduced pressure or excess pressure present.

The floating piston 48 prevents penetration of fluid from the environment, for instance seawater, into the housing 1. At least a part of the connecting chamber 46 forms a seventh sliding surface 34.4 and at least a part of the floating piston 48 forms an eighth sliding surface 36.4. The seventh sliding surface 34.4 is designed as a sliding surface of the first type a and the eighth sliding surface 36.4 is designed as a sliding surface of the second type b. Here too, it holds true that it is also conceivable that the seventh sliding surface 34.4 is designed as a sliding surface of the second type b and the eighth sliding surface is designed as a sliding surface of the first type a.

The sliding surface 34 of the first type a, as in the first embodiment, is provided with materials based on polyether ether ketone, such as for instance PEEK-BG, optionally with friction-reducing or other additions. The sliding surface 36 of the second type b is provided with a form of stainless steel, viz. stainless steel 2205.

When the control slide 22 has been brought to the second position, the body 2 is moved up. When after this the control slide 14 is returned to the first position, the body 2 falls onto the pile, which is thereby driven at least partly into the surface.

Although in each of the embodiments shown the body is moved up and down, corresponding pile drivers according to the invention are conceivable which are suitable for pile-driving at an angle, sometimes referred to as raked pile driving, and even for horizontal pile-driving. In such embodiments, a high pressure is used in the second pressure chamber, so that the body has sufficient force of impact without requiring gravity to be used.

Nor is it requisite for the invention to move the body back and forth in a hydraulic manner. The drive of the body can also take place in a mechanical manner.

Also, embodiments of the pile driver are conceivable whereby the pile driver comprises two parts which during pile-driving slide along each other, and with both parts being provided with adjacent strip-shaped sliding surfaces which are alternately of the first type and the second type. The parts are then so positioned relative to each other, and the strips are so dimensioned, that during pile-driving in each case a strip having a sliding surface of the first type slides along a sliding surface of the second type.

Although in the drawing the connection between the control slide(s) on the one hand and the control device on the other is indicated by means of connecting lines, the framework of the invention is also understood to encompass elaborations of the above-mentioned embodiments of the pile driver where the connection is wireless, or an elaboration where the control of the control slides is manual.

The invention claimed is:

1. A pile driver comprising:

a housing that, during operation of the pile driver, is underwater;

a body connected with the housing so as to be movable back and forth over a predetermined path;

a drive for moving the body back and forth over the predetermined path for the purpose of pile-driving;

wherein at least two parts of the housing and body of the pile driver are movable relative to each other, and the at least two parts have at least a first type of sliding surface and at least a second type of sliding surface which, during relative movement while pile-driving, slide along each other, wherein a seawater lubricant provides lubrication between the first type of sliding surface and the second type of sliding surface, and wherein the first type of sliding surface comprises polyether ether ketone and the second type of sliding surface is a stainless steel.

2. The pile driver according to claim 1, wherein the stainless steel of the second type of sliding surface is stainless steel 2205.

3. The pile driver according to claim 2, wherein the lubricant consists at least substantially of seawater.

4. The pile driver according to claim 1, wherein at least a part of the housing forms a sliding surface of the first type and at least a part of the body forms a sliding surface of the second type.

5. The pile driver according to claim 1, wherein at least a part of the housing forms a sliding surface of the second type and at least a part of the body forms a sliding surface of the first type.

6. The pile driver according to claim 1, wherein the body comprises an impact weight.

7. The pile driver according to claim 1, wherein the pile driver further includes at least one fluid pressure connection which extends from an inside of a pressure chamber included in the housing to a position outside the pressure chamber, while in the fluid pressure connection a sealing which is movable relative to the fluid pressure connection is included.

8. The pile driver according to claim 7, wherein at least a part of the fluid pressure connection forms a sliding surface of the first type and at least a part of the sealing forms a sliding surface of the second type.

9. The pile driver according to claim 7, wherein at least a part of the fluid pressure connection forms a sliding surface of the second type, and at least a part of the sealing forms a sliding surface of the first type.

10. The pile driver according to claim 7, wherein the drive is arranged for generating a varying fluid pressure, wherein a first fluid pressure connection of the at least one fluid pressure connection extends between the drive and a space in the housing, while at least a part of the body is included in the housing so as to be movable back and forth for moving the body back and forth relative to the housing through the varying fluid pressure.

11. The pile driver according to claim 7, wherein a second fluid pressure connection of the at least one fluid pressure connection extends between a space in the housing and an environment outside the housing.

12. The pile driver according to claim 1, wherein the pile driver is further provided with supply means for supplying water from an environment of the housing, between the first and second sliding surfaces when the housing is underwater.

* * * * *